US006238248B1

(12) United States Patent
Ogura et al.

(10) Patent No.: US 6,238,248 B1
(45) Date of Patent: May 29, 2001

(54) CONNECTOR FOR THIN CARTRIDGE

(75) Inventors: Toshiaki Ogura, Kawasaki; Yuzuru Ohta, Otsu, both of (JP)

(73) Assignee: Japan Solderless Terminal Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/213,250

(22) Filed: Dec. 17, 1998

(30) Foreign Application Priority Data

Dec. 17, 1997 (JP) ..... 9-348111

(51) Int. Cl.[7] ..... H01R 24/00
(52) U.S. Cl. ..... 439/660; 439/630
(58) Field of Search ..... 439/660, 630–637, 439/567, 571

(56) References Cited

U.S. PATENT DOCUMENTS 4,932,904 * 6/1990 Ichitsubo ..... 439/630
5,035,641 * 7/1991 Van-Santbrink et al. ..... 439/567
5,117,330 * 5/1992 Miazga ..... 439/567
5,230,638 * 7/1993 DiVesti ..... 439/567
5,267,881 * 12/1993 Matuzaki ..... 439/660
5,295,843 * 3/1994 Davis et al. ..... 439/637
5,462,451 * 10/1995 Yeh ..... 439/567
5,641,308 * 6/1997 Bixler et al. ..... 439/660

FOREIGN PATENT DOCUMENTS 8-17515 1/1996 (JP) .
8-315935 11/1996 (JP) .
11-137840 5/1999 (JP) .

* cited by examiner

*Primary Examiner*—Renee Luebke
*Assistant Examiner*—Briggitte R. Hammond
(74) *Attorney, Agent, or Firm*—Rader, Fishman & Grauer

(57) ABSTRACT

A thin cartridge to which a connector of the present invention is applied has an insertion space therein which is open through an opening formed on an end face of a frame thereof. A printed circuit board having terminals patterned on an edge surface portion thereof is provided on one of surfaces defining the insertion space. The connector includes an engagement wall to be inserted into the frame as a single component for engagement with the frame of the cartridge. The engagement wall has first and second opposite faces exposed to the outside. Arrangement of contact members retained in retention grooves formed in the first face can be viewed from the side opposed to the first face.

18 Claims, 6 Drawing Sheets

CONNECTOR FOR THIN CARTRIDGE

CROSS REFERENCE TO RELATED APPLICATION

This application claims priority benefits under 35 USC §119 of Japanese Application Ser. No. 9-348111 filed on Dec. 17, 1997, the disclosure of which is incorporated by reference.

BACKGROUND OF THE INVENTION

1. Field of the Invention

The present invention relates to a connector for use with a thin cartridge such as an IC memory cartridge.

2. Description of Related Arts

A connector typically has contacts which are to be connected to terminals of a printed circuit board mounted in a frame of a cartridge. Conventionally, the connection of the contacts to the terminals is achieved by inserting the entire connector into an opening formed in a front face of the frame.

The cartridge for use with such a conventional connector should be designed so that the opening of the frame has a greater size (i.e., greater length and width) than a front face of the connector. Therefore, the cartridge tends to have a greater thickness. This makes it difficult to reduce the thickness of the cartridge.

On the other hand, where a cartridge is constructed such that a part of a printed circuit board thereof projects from a front face of a frame thereof, the entire connector need not be inserted into the inside of the cartridge in the aforesaid manner. Therefore, it is relatively easy to reduce the thickness of the cartridge. In this case, however, terminals patterned on a front surface portion of the printed circuit board are exposed to the outside, so that an IC (i.e., intergrated circuit) on the printed circuit board is susceptible to electrostatic discharge damage.

A thin cartridge has been proposed which includes a hollow frame having an insertion space therein with an opening on one face thereof, and a printed circuit board provided on an interior surface of the frame in the insertion space and having terminals patterned thereon. A connector for use with this thin cartridge is disclosed, for example, in Japanese Utility Model Publication No. 5-5671 (1993).

The connector disclosed in this publication includes two types of wall portions as means for engagement with the frame of the cartridge. More specifically, a first wall portion is to be inserted into the insertion space through the opening of the frame of the cartridge, while a second wall portion is to be located outside the frame with the printed circuit board interposed between the first wall portion and the second wall portion. In this case, the thickness of the cartridge can advantageously be reduced in comparison with the case where the entire connector is inserted in the frame.

However, the complexity and size of the connector tend to be increased by the provision of the two types of wall portions for engagement with the interior and exterior of the frame. Further, contacts of the connector to be connected to the terminals of the cartridge are respectively provided in retention grooves formed on a face of the first wall portion opposed to the second wall portion. In an inspection process after production of the connector, whether or not the contacts of the connector are properly arranged in the retention grooves is checked by viewing the connector from the front side of the first and second wall portions. This makes the inspection difficult.

Particularly where the arrangement of the contacts is automatically checked through image processing with the use of a CCD (i.e., charge-coupled device) camera, an image obtained by viewing from the front side of the first and second wall portions is used, so that the inspection accuracy is reduced. As a result, the automatic inspection through the image processing is virtually impossible.

SUMMARY OF THE INVENTION

It is an object of the present invention to provide a connector which has a simpler construction and a smaller size and can be subjected to automatic inspection for checking whether or not contact members thereof are properly set therein.

In accordance with a preferred aspect of the present invention for achievement of the aforesaid object, there is provided a connector for use with a thin cartridge which comprises a frame having an insertion space therein which is open through an opening formed on an end face thereof and a printed circuit board having terminals patterned on an edge surface portion thereof and provided on one of surfaces defining the insertion space, the connector comprising: a base having a connection surface which is to be brought into contact with the cartridge; and an engagement wall projecting from the connection surface of the base and to be inserted into the insertion space through the opening of the frame of the cartridge for engagement with the frame of the cartridge. The engagement wall includes first and second opposite faces exposed to the outside. The first face has a plurality of retention grooves respectively retaining a plurality of contact members. The retention grooves retain the contact members so that the respective contact members are brought into contact with the corresponding terminals when the engagement wall is engaged with the frame of the cartridge.

The conventional connector has a complicated construction because the two types of engagement walls, i.e., the first engagement wall to be inserted into the frame and the second engagement wall to be engaged with the exterior of the frame, are provided for engagement with the cartridge.

In accordance with this aspect, on the contrary, the construction of the connector can be simplified because the single engagement wall which is to be inserted into the frame is employed for the engagement with the cartridge. Further, the contact members retained in the retention grooves formed in the first face of the engagement wall can be observed from the side opposed to the first face. Therefore, visual inspection of the arrangement of the contact members as well as automatic inspection thereof through image processing can easily be performed.

DESCRIPTION OF THE PREFERRED EMBODIMENT

A preferred embodiment of the present invention will hereinafter be described with reference to the attached drawings.

Figure 1:
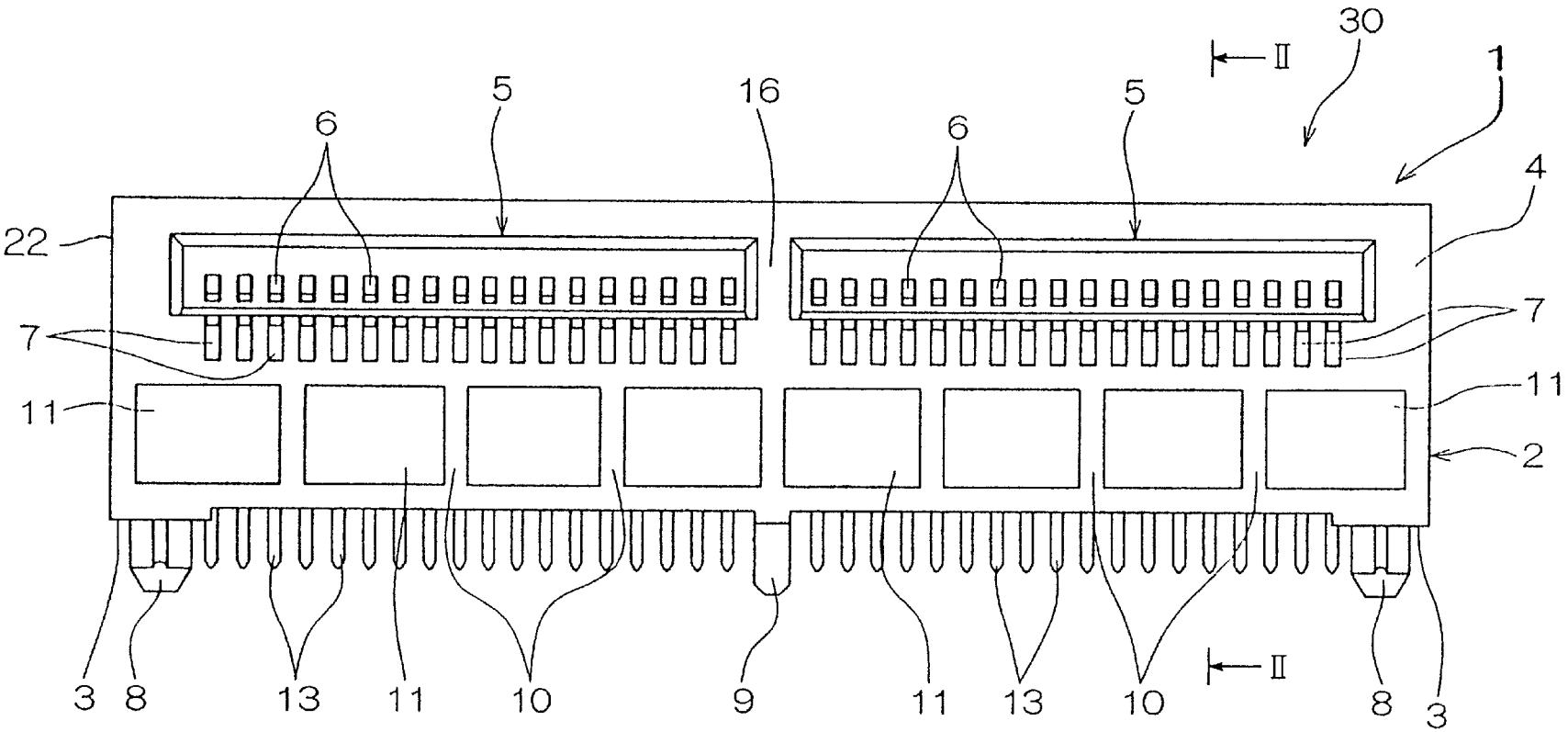
FIG. 1 is a front view illustrating major portions of a connector according to one embodiment of the present invention.
Figure 2:
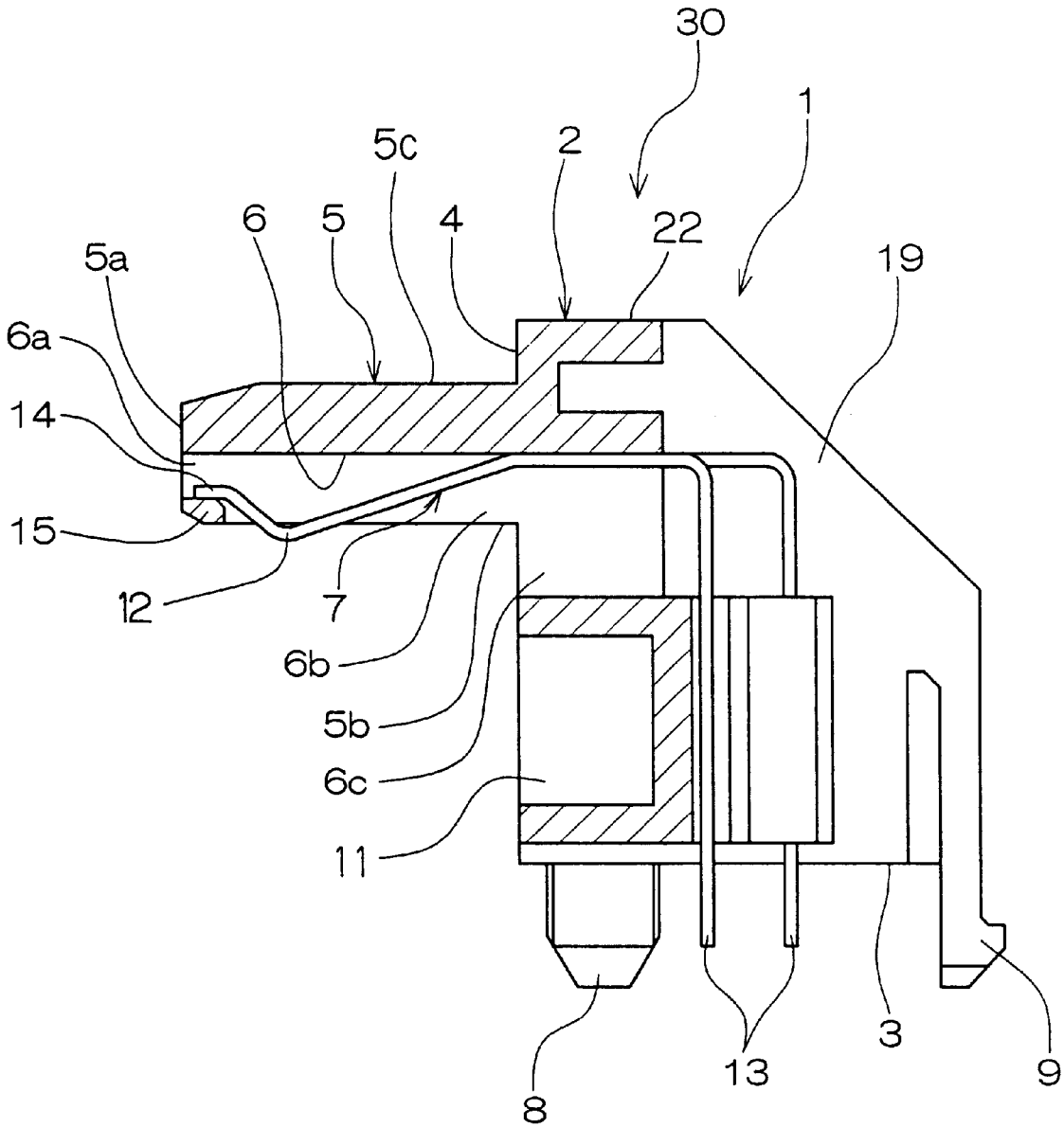
FIG. 2 is a sectional view taken along a line II—II in FIG. 1.

Referring to FIGS. 1 and 2, a connector 30 according to the embodiment of the present invention includes a connector body 1 and a plurality of contact members 7 held by the connector body 1.

Figure 5:
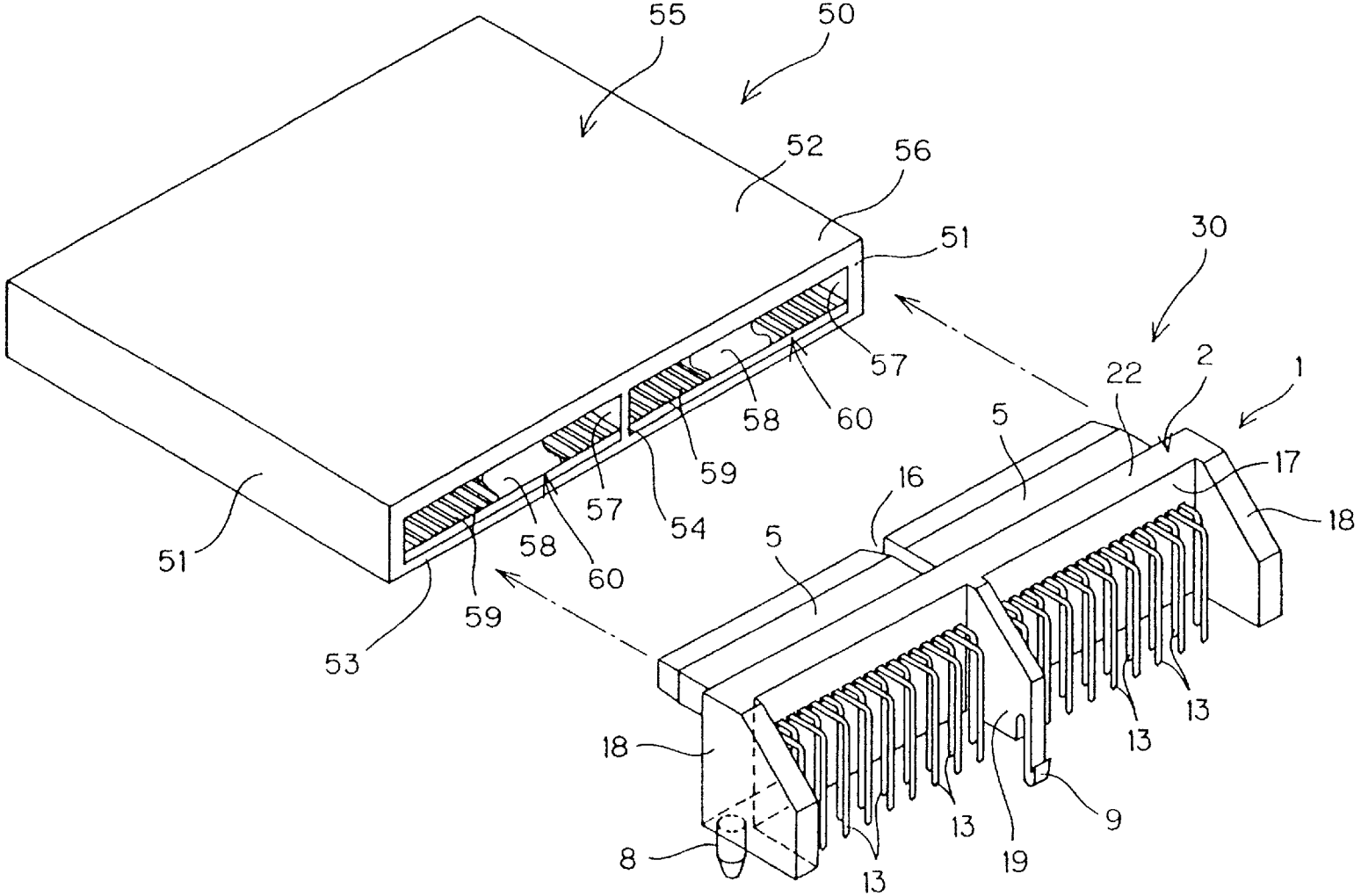
FIG. 5 is a perspective assembly diagram illustrating the connector to be connected to a cartridge.

The connector body 1 includes a base 2 having an attachment surface 3 at its lower side and a connection surface 4 at its front side. A pair of split walls 5, 5 constituting an engagement wall for engagement with a frame 55 of a cartridge 50 which will be described later with reference to FIG. 5 are provided on the connection surface 4 as forwardly projecting therefrom. The base 2 and the split walls 5, 5 constitute the connector body 1.

The split walls 5, 5 are formed with a plurality of contact member retaining grooves 6 arranged in juxtaposition and opening to the front side and the lower side thereof. The contact members 7 are respectively retained in the contact member retaining grooves 6 with portions thereof projecting to the lower side. The split walls 5, 5 constituting the engagement wall has first and second opposite wall faces 5*b* and 5*c* exposed to the outside.

Figure 3:
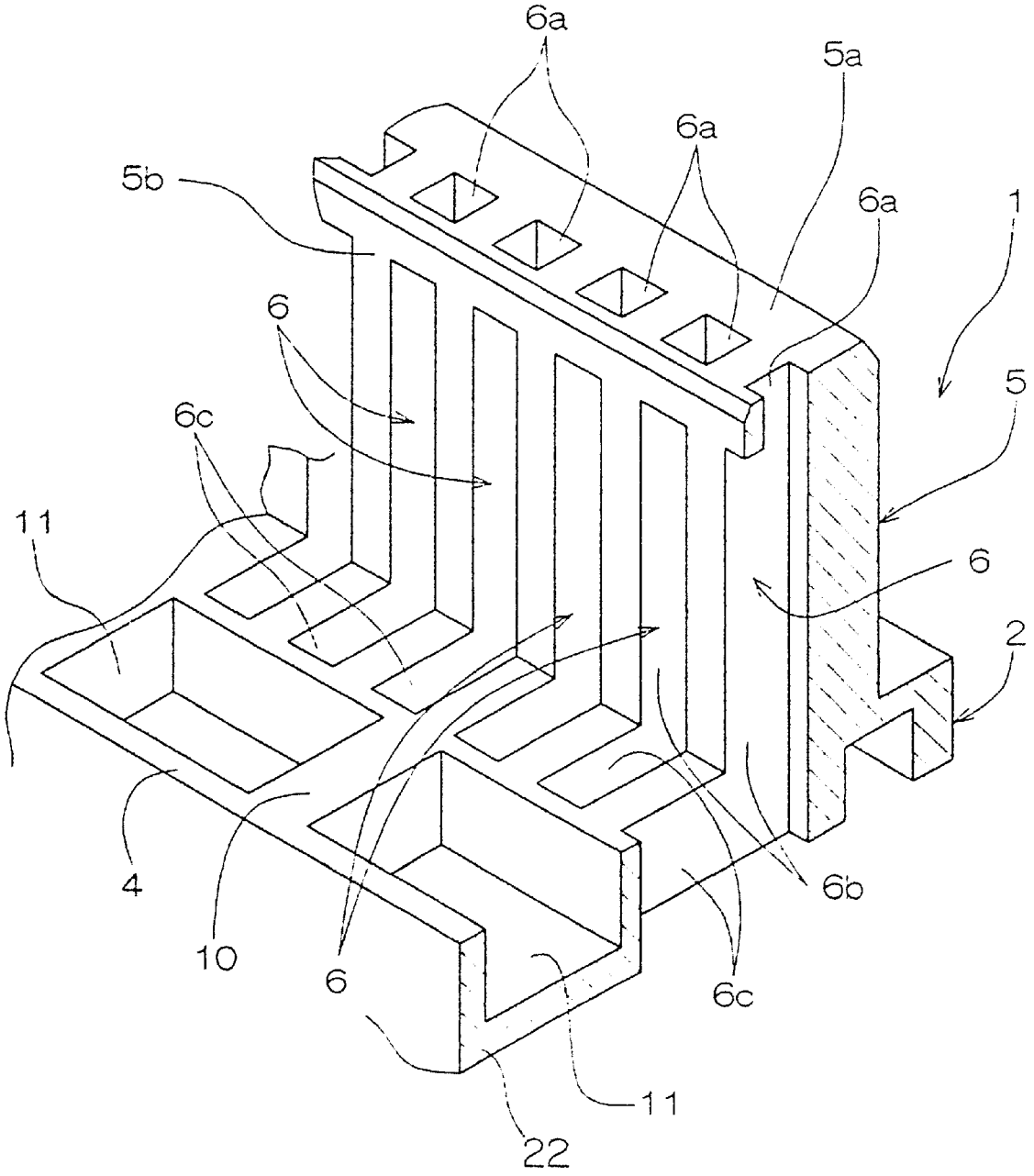
FIG. 3 is a fragmentary perspective view of a connector body.

Referring to FIGS. 2 and 3, the contact member retaining grooves 6 each have openings 6*a* and 6*b* which open on an end face 5*a* of the split wall 5 and the first wall face 5*b*, respectively. Further, the contact member retaining grooves 6 each have a through-hole 6*c* extending through the base 2 to the connection surface 4 of the base 2. A plurality of recesses 11 are provided in the connection surface 4 of the base 2 as being separated from each other by ribs 10.

Referring to FIG. 2, the contact members 7 are one-piece components which each include a contact 12 having a V-shaped bent portion, a lead 13 extending from the contact 12 and bent generally perpendicularly to the contact 12, and a hook portion 14 provided at an end of the contact 12. The hook portion 14 is resiliently hooked on an edge portion 15 of the contact member retaining groove 6. An end portion of the lead 13 projects below the attachment surface 3 of the base 2. The bent portion of the contact 12 projects outwardly from the opening 6*b* of the split wall 5.

Figure 4:
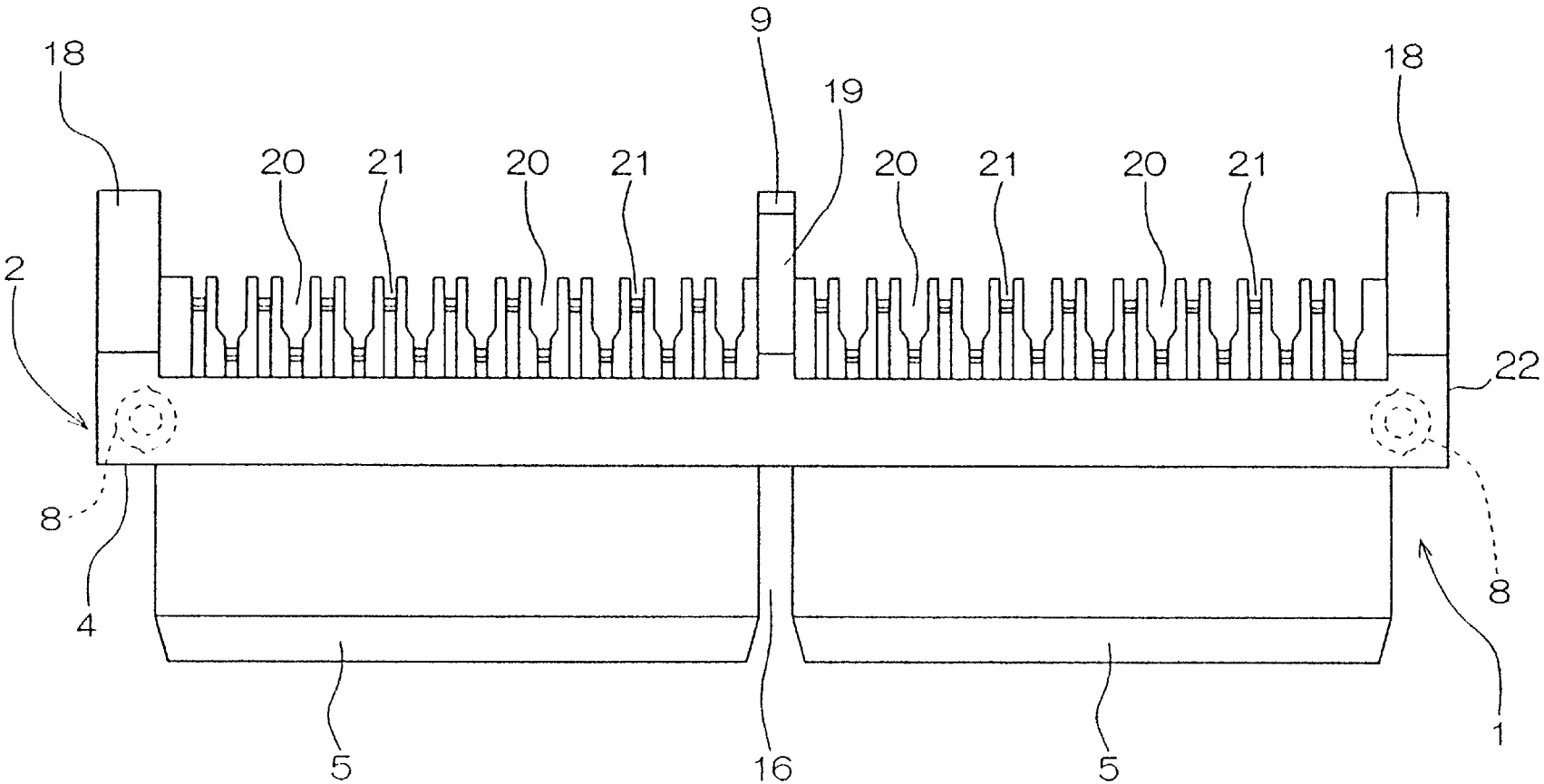
FIG. 4 is a plan view of the connector body.

Referring to FIGS. 1 and 4, the pair of split wall 5, 5 which are to be inserted into the frame 55 of the cartridge 50 are arranged in juxtaposition along the arrangement of the contact members 7. An engagement recess 16 is provided as a clearance between the split walls 5, 5 and extends from the front faces of the split walls 5, 5 to the connection surface 3 of the base 2. When the connector 30 is connected to the cartridge 50, the engagement recess 16 receives a reinforcement wall 54 of the cartridge 50 (which will be described later) for engagement with the reinforcement wall 54. In FIG. 4, reference numerals 20, 21 denote guide grooves for guiding the leads 13 extending from the contacts 12.

The base 2 includes a base body 22 of an elongate parallelepiped shape extending along the juxtaposed split walls 5, 5. A first face of the base body 22 constitutes the connection surface 4 from which the split walls 5, 5 project. Generally trapezoidal side wall portions 18 project from right and left edge portions of a back face 17 of the base body 22 opposite to the connection surface 4. Further, a generally trapezoidal side wall portion 19 projects from a middle portion of the back face 17 of the base body 22.

The attachment surface 3 of the base 2 is constituted by a bottom face of the base body 22 and bottom faces of the side wall portions 18, 18, 19. The attachment surface 3 of the base 2 is provided with a pair of first projections 8, 8 for attaching the connector 30 to an attachment object 23 such as a printed circuit board (as indicated by two-dot-and-dash lines in FIG. 6) and a second projection 9 as lock means.

The first projections 8, 8 each have a circular cross section, and extend from the attachment surface 3 of the base body 22 adjacent the right and left side wall portions 18, 18. The first projections 8, 8 are adapted to be engaged with engagement holes 27 of the attachment object 23, and function as positioning projections to restrict movement of the base 2 along the attachment surface 3.

The second projection 9 downwardly extends from the middle side wall portion 19. The second projection 9 includes a bendable cantilever arm 24 extending perpendicularly to the attachment surface 3, and a hook portion 25 provided at a distal end of the arm 24.

The hook portion 25 is adapted to be inserted into a through-hole 28 of the attachment object 23 and hooked to an outlet edge portion 32 of the through-hole 28 for engagement therewith. The hook portion 25 has an inclined cam surface 29 which is to be brought into abutment against an inlet edge portion 31 of the through-hole 28 to bend the arm 24 when the hook portion 25 is inserted into the through-hole 28 of the attachment object 23. The arm 24 is resiliently deformed in contact with the cam surface 29 by a force passively applied thereto when the hook portion 25 is forced into the through-hole 28. This ensures smooth insertion of the arm 24 into the through-hole 28. The hook portion 25, after having passed through the through-hole 28, restores its original shape and is brought into engagement with the outlet edge portion 32 of the through-hole 28. Thus, the base 2 is locked to the attachment object 23.

The side wall portion 19 has a slit 26 formed adjacent the arm 24 for permitting the deformation of the arm 24. The slit 26 provides a space sufficient for the deformation of the arm 24, while the second projection 9 does not project from the attachment surface 3 to a greater extent. As a result, the arm 24 can be deformed sufficiently to bring the hook portion 25 thereof into and out of engagement with the edge portion 32.

The first and second projections 8, 9 are engaged with the corresponding portions of the attachment object 23 with the attachment surface 3 abutting against the surface of the attachment object 23, whereby the base 2 is fixed to the attachment object 23. Particularly, the hook portion 25 of the second projection 9 is hooked in engagement with the attachment object 23 for prevention of disengagement thereof. Thus, the base 2 can firmly be fixed to the attachment object 23.

The ends of the leads 13 are soldered on the attachment object 23 (e.g., printed circuit board) with the base 2 thus fixed to the attachment object 23 (printed circuit board). Therefore, the soldering operation can easily be performed without such an inconvenience that the connector is inclined with respect to the attachment object during the operation. Since the base 2 is firmly fixed to the attachment object 23 (printed circuit board), stresses applied to the soldered portions when the connector 30 is attached to or detached from the cartridge 50 can remarkably be reduced. As a result, the durability of the soldered portions can be improved.

In FIG. 5, there are shown the connector 30 and the thin cartridge 50 to be connected to the connector 30. The frame 55 of the cartridge 50 is a one-piece hollow frame made of a synthetic resin. The frame 55 has right and left side walls 51, 51, an upper wall 52 and a lower wall 53 which extend along the entire length thereof, and the reinforcement wall 54 connecting the upper wall 52 and the lower wall 53. The frame 55 has an insertion space 58 therein with a pair of openings 57 formed on one end face 56 thereof and separated from each other by the reinforcement wall 54. A printed circuit board 60 having terminals 59 pattered thereon is mounted on one interior surface of the insertion space 58 (which corresponds to an interior surface of the lower wall 53 in this embodiment). The split walls 5, 5 of the connector are inserted into the insertion space 58 of the frame 55 with the reinforcement wall 54 fitted in the clearance 16 of the connector, thereby permitting the connector to be connected to the cartridge 50.

In the cartridge 50, the walls 51, 51, 52, 53 defining the insertion space 58 are integrally formed. This arrangement drastically enhances the strength of the frame, compared with a case where the frame is composed of separate wall components. Therefore, the upper wall 52 and the lower wall 53 hardly deform when the split walls 5, 5 of the connector 30 are inserted into the insertion space 58.

In addition, since the reinforcement wall 54 connecting the upper and lower walls 52 and 53 is also an integral portion of the frame, the deformation resistance strength of the upper and lower walls 52, 53 is further enhanced. Although the single reinforcement wall 54 is provided in this embodiment, a plurality of reinforcement walls 54 may be provided. In such a case, the deformation resistance strength of the upper and lower walls 52, 53 can still further be enhanced. To impart a sufficient strength to the frame, it is merely necessary that at least portions of the upper and lower walls 52, 53 adjacent to the open end of the frame 55 be formed integrally.

Figure 6:
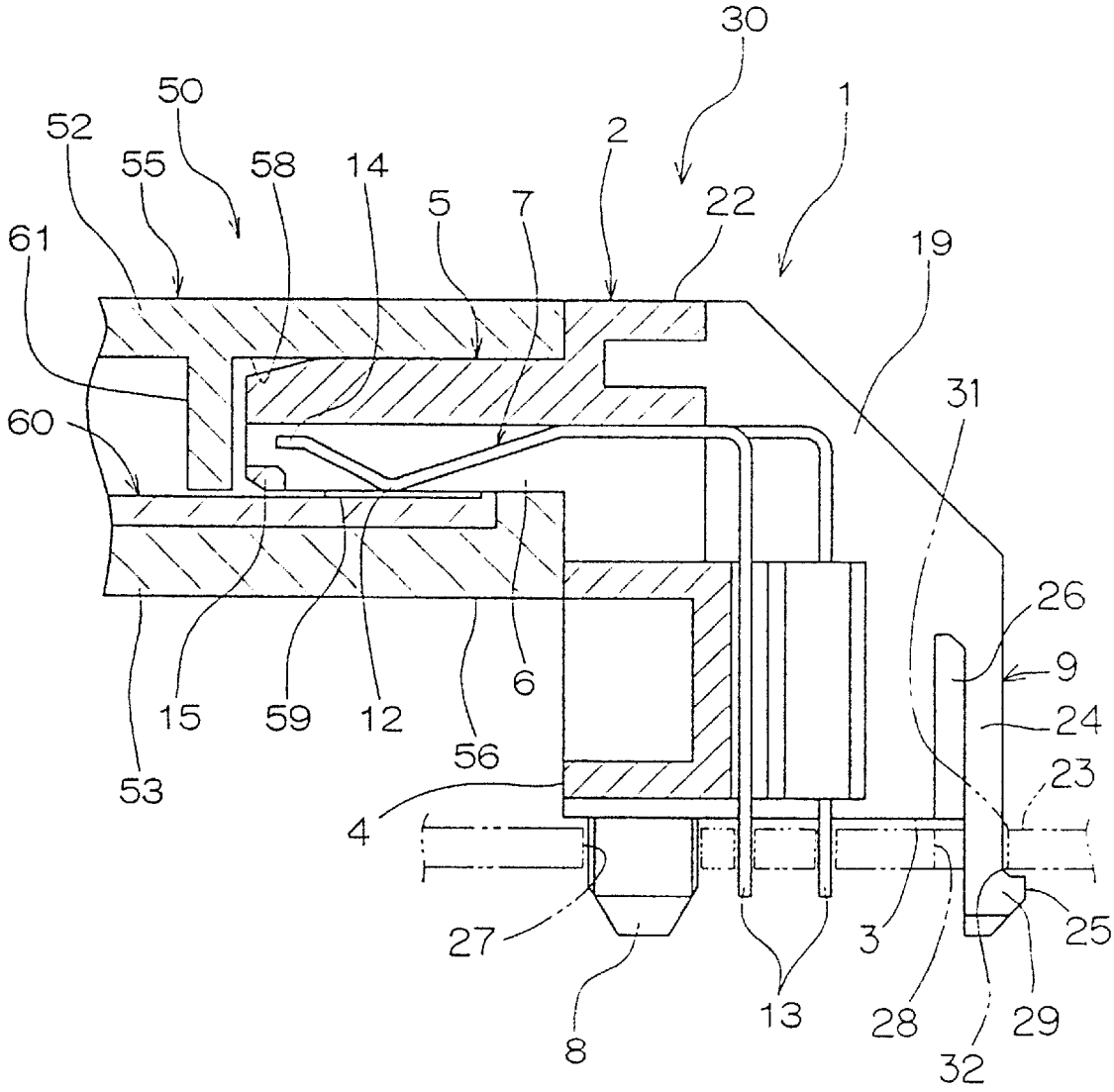
FIG. 6 is a sectional view illustrating a state of the connector connected to the cartridge.

When the connector 30 is to connected to the cartridge 50, the front edges of the split walls 5 of the connector 30 are introduced into the openings 57 of the cartridge 50 for insertion of the split walls 5 into the insertion space 58 as shown in FIG. 5. Upon the connection of the connector 30 to the cartridge 50 by the insertion, the end faces 5*a* of the split walls 5 almost reach a reinforcement rib 61 extending from the upper wall 52 to the lower wall 53 of the cartridge 50 as shown in FIG. 6. The contacts 12 are brought into contact with the terminals 59 of the printed circuit board 60, whereby the contact members 7 are resiliently deformed and forced into the contact member retaining grooves 6 and the hook portions 14 are brought apart from the edge portions 15.

In accordance with this embodiment, the split walls 5, 5 of a single type which are to be inserted into the frame 55 of the cartridge 50 are employed for engagement with the frame 55 and, therefore, the construction of the connector 30 can be simplified. Further, the connector 30 has a smaller thickness and, hence, a smaller size than the conventional connector which employs two types of wall portions. The first wall faces 5*b* of the split walls 5 are exposed to the outside, so that the arrangement of the contact members 7 retained in the contact member retaining grooves 6 formed in the first wall faces 5*b* can easily be viewed from the side opposed to the first wall face 5*b*. This permits automatic inspection through image processing.

Where the reinforcement wall 54 is provided in the frame 55 of the cartridge 50 to split the openings 57 formed in the end face 56 of the cartridge 50 as shown in FIG. 5, the reinforcement wall 54 is fitted in the clearance 16 for connection of the connector 30 to the cartridge 50. That is, the cartridge 50 has the sufficiently strong frame 55 with which the connector 30 is engaged. As a result, the connector 30 provides an enhanced connection strength with respect to the cartridge 50 connected thereto via the single-type split walls 5, 5 alone inserted in the frame 55.

Since the engagement recess 16 to be engaged with the reinforcement wall 54 extends to the connection surface 4 of the base 2, deep engagement of the connector 30 with the cartridge 50 can be achieved. Thus, the size of the combination of the connector and the cartridge can be reduced and, accordingly, the size of a device (e.g., game machine) to which the connector 30 is applied can be reduced.

Further, the plurality of recesses 11 are formed in the connection surface 4 of the base 2 as being separated from each other by the ribs 10, so that the lightening of the base 2 as well as the enhancement of the deformation resistance strength of the connector body 1 can be achieved. As a result, the cartridge 50 can stably be sustained by the connector connected thereto.

The present invention is not limited to the embodiment described above. Although the engagement recess 16 extends to the connection surface 4 of the base 2 in the embodiment described above, the engagement recess 16 may extend to a position apart from the connection surface 4.

In the embodiment described above, the second projection 9 having the hook portion is provided on the middle side wall portion 19. Alternatively, second projections 9 may be provided on the right and left side wall portions 18, 18. Further, three side wall portions, i.e., the right and left side wall portions 18, 18 and the middle side wall portion 19, are provided in the embodiment. However, the number of the side wall portions is not critical as long as a plurality of side wall portions are provided. The first projections 8 provided on the attachment surface 3 for positioning may project from either or both of the base body 22 and the side wall portions. Various modifications may be made to the embodiment within the scope and spirit of the present invention.

What is claimed is:

1. A connector for use with a cartridge which comprises a frame having an insertion space therein which is open through an opening formed on an end face thereof and a printed circuit board having terminals patterned on an edge surface position thereof and provided on one of the surfaces thereby defining the insertion space, the connector comprising:

a base having a connection surface which is to be brought into contact with the cartridge; and an engagement wall projecting from the connection surface of the base and to be inserted into the insertion space through the opening of the frame of the cartridge for engagement with the frame of the cartridge;

the engagement wall including first and second faces, wherein said first and second faces are opposite to each other and are externally exposed;

the first face having a plurality of retention grooves respectively retaining a plurality of contact members;

the retention grooves retaining the contact members so that the respective contact members are brought into contact with the corresponding terminals when the engagement wall is engaged with the frame of the cartridge; and the connection surface of the base includes a plurality of recesses separated from each other by ribs and separated from the retention grooves.

2. The connector as set forth in claim 1, wherein the engagement wall includes a plurality of split walls juxtaposed along arrangement of the contact members, wherein an engagement recess is provided between each adjacent pair of split walls as extending from front edges of the split walls to the connection surface, wherein the engagement recess is brought into engagement with a reinforcement wall provided across the opening of the frame of the cartridge.

3. The connector as set forth in claim 1 wherein the base includes a base body and a plurality of side walls each projecting from a rear face opposite the connection surface of the main base body, further wherein the connection surface faces in a direction toward the cartridge.

4. The connector as set forth in claim 3, wherein the base has an attachment surface to be brought into abutment against an attachment object to which the connector is attached, and the side walls include part of the attachment surface.

5. A connector for use with a cartridge which comprises a frame having an insertion space therein which is open through an opening formed on an end face thereof and a printed circuit board having terminals patterned on an edge surface position thereof and provided on one of the surfaces thereby defining the insertion space, the connector comprising:

a base having a connection surface which is to be brought into contact with the cartridge; and an engagement wall projecting from the connection surface of the base and to be inserted into the insertion space through the opening of the frame of the cartridge for engagement with the frame of the cartridge;

the engagement wall including a first face, wherein said first face is externally exposed;

the first face having a plurality of retention grooves respectively retaining a plurality of contact members;

the retention grooves retaining the contact members so that the respective contact members are brought into contact with the corresponding terminals when the engagement wall is engaged with the frame of the cartridge;

wherein the base includes a base body and a plurality of side walls each projecting from a rear face opposite the connection surface of the base body; and the base has an attachment surface to be brought into abutment against an attachment object to which the connector is attached, and the side walls include part of the attachment surface;

said connector further comprises a lock means provided on the attachment surface as projecting from at least one of the side walls and to be resiliently engaged with the attachment object to fix the base to the attachment object; and the connection surface of the base includes a plurality of recesses separated from each other by ribs and separated from the retention grooves.

6. The connector as set forth in claim 5, wherein the lock means includes a bendable cantilever arm extending perpendicularly to the attachment surface, and a hook portion provided at a distal end of the cantilever arm.

7. The connector as set forth in claim 6, wherein the side wall provided with the lock means has a slit formed adjacent the arm, the slit permitting the arm to be bent to be deformed.

8. The connector as set forth in claim 6, wherein the hook portion includes a cam surface which is to be brought into contact with an inlet edge portion of a through-hole formed in the attachment object so as to bend the arm when the hook portion is inserted into the through-hole.

9. The connector as set forth in claim 6, further comprising a positioning projection projecting from the attachment surface of the base and to be engaged with the attachment object for restricting movement of the base along the attachment surface.

10. A connector comprising:

a base having a connection surface; and an engagement wall projecting from the connection surface of the base;

the engagement wall including first and second faces, wherein said first and second faces are opposite to each other and are externally exposed;

the first face having a plurality of retention grooves respectively retaining a plurality of contact members; wherein the retention grooves retain contact members attached to a cartridge, and the connection surface of the base includes a plurality of recesses separated from each other by ribs and separated from the retaining groove.

11. The connector as set forth in claim 10, wherein the engagement wall includes a plurality of split walls juxtaposed along arrangement of the contact members, wherein an engagement recess is provided between each adjacent pair of split walls as extending from front edges of the split walls to the connection surface.

12. The connector as set forth in claim 10, wherein the base includes a base body and a plurality of side walls each projecting from a rear face opposite the connection surface of the main base body, further wherein said connection surface faces in a direction toward the cartridge.

13. The connector as set forth in claim 12, wherein the base has an attachment surface to be brought into abutment against an attachment object to which the connector is attached, and the side walls include part of the attachment surface.

14. The connector as set forth in claim 13, further comprising lock means provided on the attachment surface as projecting from at least one of the side walls and to be resiliently engaged with the attachment object to fix the base to the attachment object.

15. The connector as set forth in claim 14, wherein the lock means includes a bendable cantilever arm extending perpendicularly to the attachment surface, and a hook portion provided at a distal end of the cantilever arm.

16. The connector as set forth in claim 15, wherein the side wall provided with the lock means has a slit formed adjacent the arm, the slit permitting the arm to be bent to be deformed.

17. The connector as set forth in claim 15, wherein the hook portion includes a cam surface which is to be brought into contact with an inlet edge portion of a through-hole formed in the attachment object so as to bend the arm when the hook portion is inserted into the through-hole.

18. The connector as set forth in claim 15, further comprising a positioning projection projecting from the attachment surface of the base and to be engaged with the attachment object for restricting movement of the base along the attachment surface.

* * * * *